United States Patent [19]

Suzuki

[11] Patent Number: 4,891,572

[45] Date of Patent: Jan. 2, 1990

[54] POWER SOURCE APPARATUS

[75] Inventor: Koji Suzuki, Yokohama, Japan

[73] Assignee: Canon Kabushiki Kaisha, Tokyo, Japan

[21] Appl. No.: 238,837

[22] Filed: Aug. 23, 1988

[30] Foreign Application Priority Data

Aug. 31, 1987 [JP] Japan ..... 62-215428
Oct. 22, 1987 [JP] Japan ..... 62-265318

[51] Int. Cl.[4] ..... G05F 1/46

[52] U.S. Cl. ..... 323/284; 323/903; 355/3 CH

[58] Field of Search ..... 363/20, 21, 89, 97; 323/273, 274, 284, 285, 902, 903; 355/3 R, 3 CH, 14 CH; 361/229, 235; 250/324, 325, 326

[56] References Cited

U.S. PATENT DOCUMENTS 3,120,635 2/1964 Tully, Jr. ..... 323/274
3,359,483 12/1967 Biard ..... 323/902
4,166,690 9/1979 Bacon et al. ..... 323/271

OTHER PUBLICATIONS

Cappa et al., "Short—Circuit Protection With Optical Isolation," IBM Technical Disclosure Bulletin, vol. 20, No. 6, Nov. 1977, pp. 2145–2155.

*Primary Examiner*—Peter S. Wong
*Attorney, Agent, or Firm*—Fitzpatrick, Cella, Harper & Scinto

[57] ABSTRACT

A power source apparatus includes a high-voltage power source for applying a high voltage to a charger in a printer or copying machine, series-connected resistors for detecting a voltage of a grid or shield of the charger, and a transistor, inserted between ground and the grid or shield, for controlling the voltage of the grid or shield in accordance with an output from the series-connected resistors. The transistor may be an npn, pnp, or field effect transistor.

16 Claims, 7 Drawing Sheets

POWER SOURCE APPARATUS

BACKGROUND OF THE INVENTION

The present invention relates to a power source apparatus for supplying power to a grid or shield of a charger.

In order to eliminate irregular charging of and charge variations in a charger in a printer or a copying machine which utilizes an electrophotographic process and to stabilize a surface potential of a photosensitive drum, a grid or shield wire is arranged near the photosensitive drum and applied with a stable voltage. A conventional power source system uses a power source for generating the stable voltage by boosting a voltage by a DC-DC converter.

The DC-DC converter system has been popular since a voltage of a wide range, e.g., several tens of volts to about 1 kV, can be generated by a transistor of a low withstand voltage and the output voltage can be easily stabilized.

A reverse current with respect to a polarity of an output from the DC-DC converter generally flows to degrade power efficiency. As a result, a converter transformer becomes bulky and expensive, and its temperature rise is undesirably increased.

A conventional arrangement of a means for applying a bias voltage to a grid of a charger will be described with reference to FIG. 10.

FIG. 10 is a schematic circuit diagram showing a conventional means for applying a bias voltage to a grid of a charger in an image forming apparatus.

A charger 2 is located near the outer surface of a photosensitive drum 1, and a high-voltage power source 3 is connected to a charge wire 7 to apply a high voltage of −6 kV thereto. One input terminal of an error amplifier 4 is connected to a connecting point of series-connected resistors $R_1$ and $R_2$, and the other input terminal serves as a reference signal input terminal $P_1$. The output terminal of the error amplifier 4 is connected to a PWM (Pulse Width Modulation) circuit 5. A grid 6 is arranged near the outer surface of the photosensitive drum 1 at an opening of the charger 2 and is applied with a voltage in the range of −100 V to −900 V. The grid 6 is connected to one end of the series circuit of the resistors $R_1$ and $R_2$ and to the secondary side of a converter transformer $T_1$ through an output diode $D_1$. The collector of a switching transistor $Tr_1$ is connected to the primary side of the converter transformer $T_1$.

With the above arrangement shown in FIG. 10, the high voltage of −6 kV is applied from the high-voltage power source 3 to the charge wire 7 in the charger 2. A voltage in the range of −100 V to −900 V must be normally applied to the grid 6. A current flowing through the charge wire 7 is partially supplied to the grid 6. When a voltage of −100 V is applied to the grid 6, a current of 200 μA flows in a direction indicated by an arrow 6*a*. When a voltage of −900 V is applied to the grid 6, a current of 30 μA flows in the direction of the arrow 6*a*. The polarity of this current is set to cut off the output diode $D_1$, and the current must be consumed through the resistors $R_1$ and $R_2$ When the voltage of −100 V is applied to the grid 6, a series resistance of the resistors $R_1$ and $R_2$ must be 500 kΩ or less to reduce the current of 200 μA. When the voltage of −900 V is applied to the grid 6, a bleeder current of 1.8 mA flows through the resistors $R_1$ and $R_2$, so that their power consumption is 1.62 W. A required power is 20 mW to 30 mW, thus resulting in extreme power loss.

As can be apparent from the above description, in the conventional power source system, the sizes of the resistors $R_1$ and $R_2$ and the converter transformer $T_1$ are increased, and a high-power transistor must be used as the switching transistor $Tr_1$ accordingly, thus generating a large amount of heat.

SUMMARY OF THE INVENTION

The present invention has been made in consideration of the above situation, and has as its object to provide an improved power source apparatus for a charger.

It is another object of the present invention to provide a compact, low-cost power source apparatus.

It is still another object of the present invention to provide a power source apparatus having high efficiency.

The above and other objects, features, and advantages of the present invention will be apparent from the following detailed description in conjunction with the accompanying drawings.

DETAILED DESCRIPTION OF THE PREFERRED EMBODIMENTS

Preferred embodiments of the present invention will be described with reference to the accompanying drawings.

Figure 1:
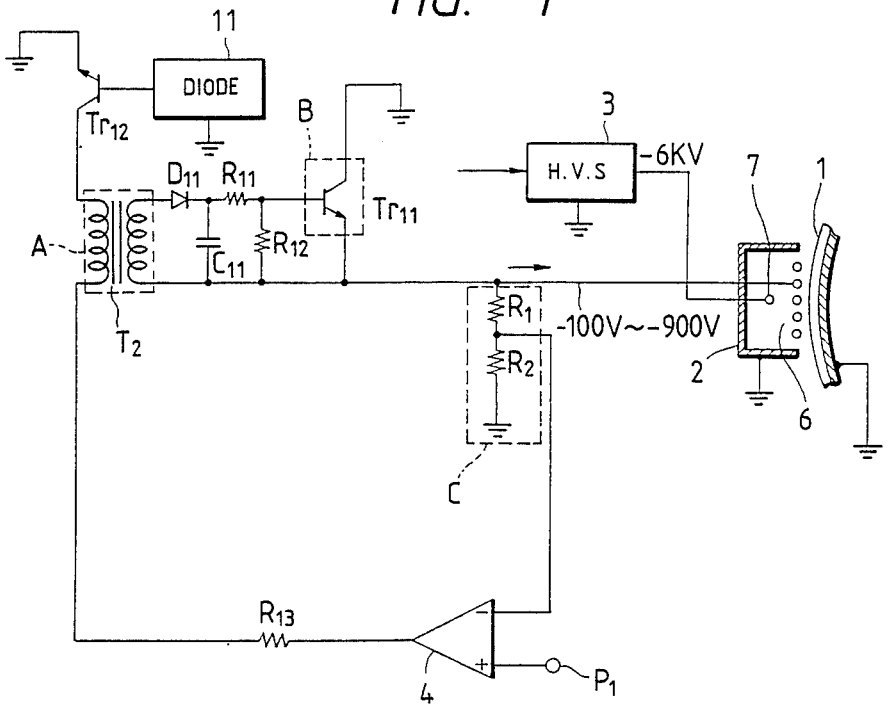
FIG. 1 is a schematic circuit diagram showing a means for applying a bias voltage to a grid of a charger in an image forming apparatus according to an embodiment of the present invention.
Figure 2:
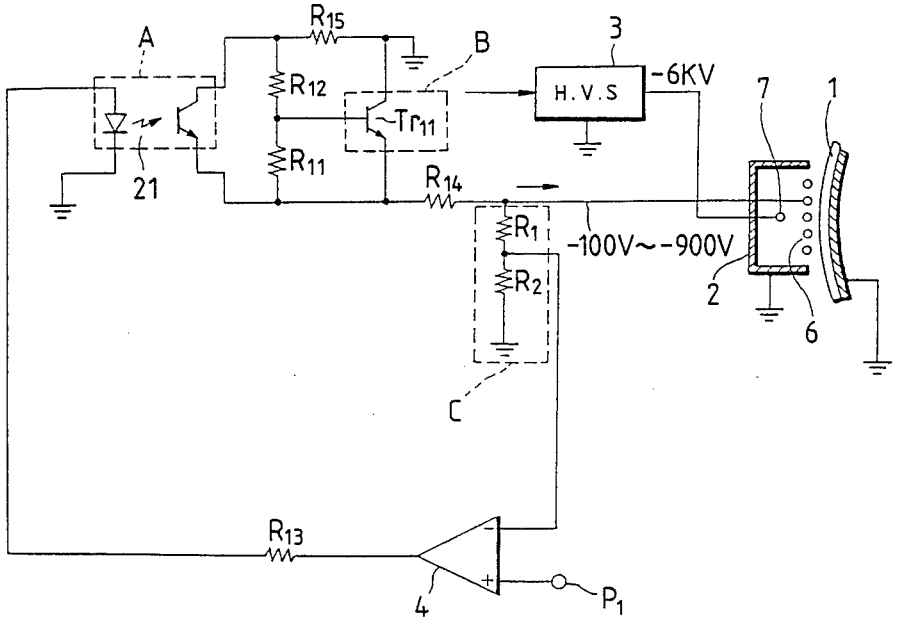
FIG. 2 is a schematic circuit diagram of an arrangement in which a photocoupler serves as an insulating means.
Figure 3:
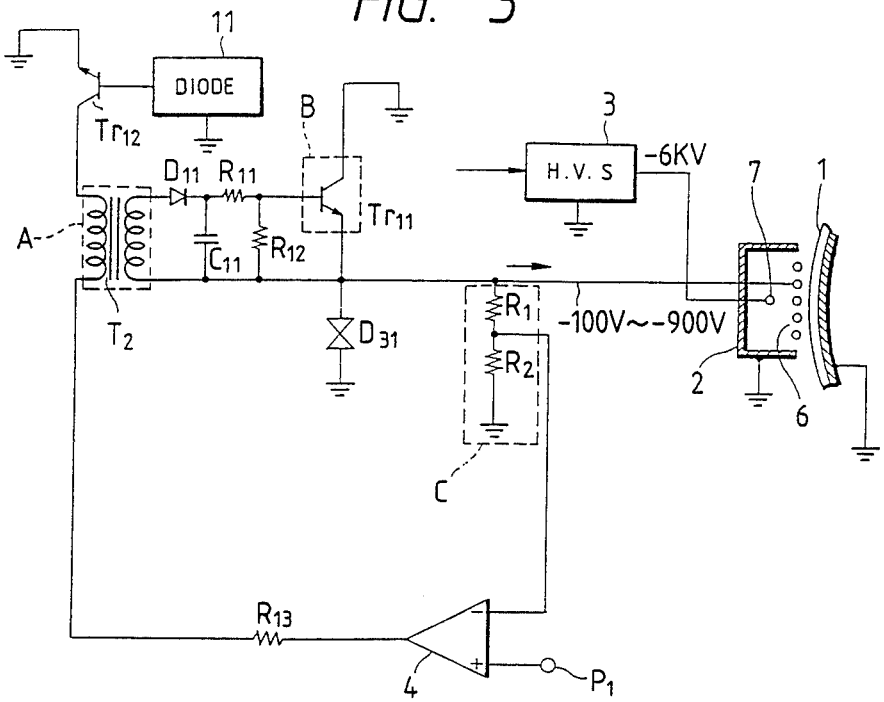
FIG. 3 is a schematic circuit diagram showing connections of a varistor in a transistor protective circuit in FIG. 1.
Figure 4:
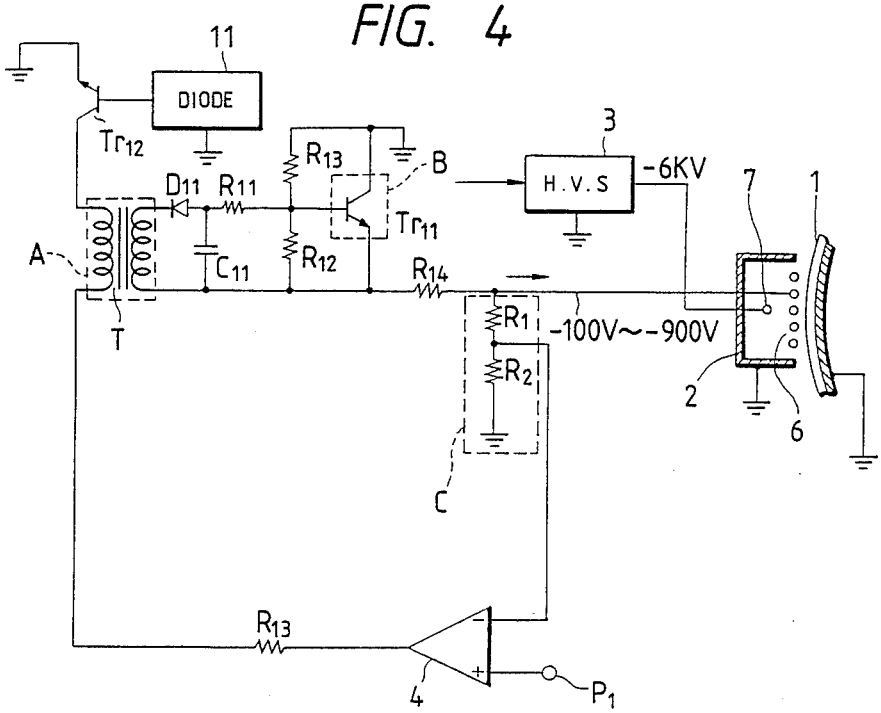
FIG. 4 is a schematic circuit diagram showing a transistor protective circuit in FIG. 1.
Figure 5:
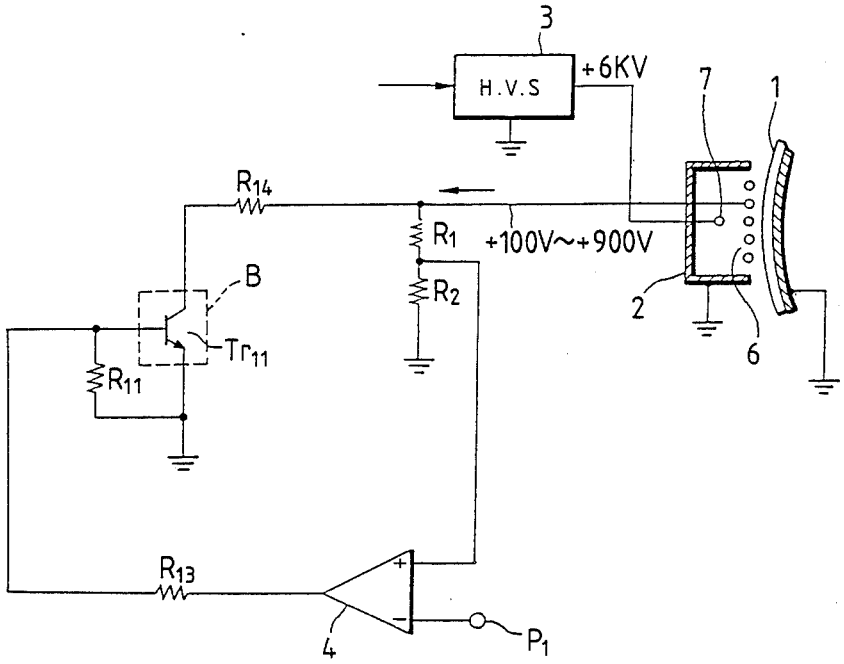
FIG. 5 is a schematic circuit diagram showing an arrangement wherein positive charging is used to eliminate the insulating means.

FIG. 1 is a schematic circuit diagram showing a means for applying a bias voltage to a grid of a charger in an image forming apparatus according to an embodiment of the present invention, FIG. 2 is a schematic circuit diagram of an arrangement in which a photocoupler serves as an insulating means, FIG. 3 is a schematic circuit diagram showing connections of a varistor in a transistor protective circuit in FIG. 1, FIG. 4 is a schematic circuit diagram showing a transistor protective circuit in FIG. 1, FIG. 5 is a schematic circuit diagram showing an arrangement wherein positive charging is used to eliminate the insulating means, and FIG. 6 is a schematic circuit diagram showing an arrangement without an error amplifier from the arrangement of FIG. 5.

Referring to FIG. 1, an npn transistor $Tr_{11}$ having a high withstand voltage is connected between a grid 6 and ground and constitutes a series regulator B. A pulse transformer $T_2$ is connected to a small-signal transistor $Tr_{12}$ and receives an oscillation output from an oscillator 11 through the transistor $Tr_{12}$. The pulse transformer $T_2$ constitutes an isolation circuit inserted in a circuit for applying a feedback output of a detection output of the grid voltage to the base of the transistor $Tr_{11}$. Resistors $R_1$ and $R_2$ have high resistances and constitute a detector C for detecting the grid voltage. An error amplifier 4 has an input terminal $P_1$. A resistor $R_{13}$ is connected to the output of the error transformer 4. A diode $D_{11}$ serves as a rectifying diode.

The same reference numerals as in the conventional apparatus denote the same parts in this embodiment, and a detailed description thereof will be omitted.

A means for applying a bias voltage to a grid of a charger will be described with reference to FIG. 1.

Referring to FIG. 1, a high voltage of −6 kV is applied from a high-voltage power source 3 to a charge wire 7 of a charger 2. A voltage in the range of −100 V to −900 V must be normally applied to the grid 6.

A detection output from the detector C for detecting a voltage of the grid 6 or the shield of the charger 2 is applied to one input terminal of an error amplifier 4 and is compared with a reference signal applied to the other input terminal $P_1$. A comparison output from the error amplifier 4 is applied to the pulse transformer $T_2$ serving as the insulating means A. The reference signal is changed to change the grid voltage.

An AC signal amplitude-modulated by the output from the error amplifier 4 is isolated by the pulse transformer $T_2$. The isolated signal is rectified by the diode $D_{11}$, thereby controlling a base current of the transistor $Tr_{11}$ constituting the series regulator B. The transistor $Tr_{11}$ controls the output in accordance with the detection output from the detector C.

The output detection resistors $R_1$ and $R_2$ need not consume the current flowing from the charge wire 7 to the grid 6. The resistors $R_1$ and $R_2$ can have resistances high enough to completely neglect a loss component through the resistors $R_1$ and $R_2$.

FIG. 2 shows an arrangement in which a photocoupler 21 is used, as insulating means A, in place of a pulse transformer. The photocoupler 21 is operated in accordance with an output from an error amplifier 4, thereby controlling a base current of a transistor $Tr_{11}$.

An arrangement including a transistor protective circuit serving as the series regulator in FIG. 1 will be described with reference to FIGS. 3 and 4.

Referring to FIG. 3, an overvoltage protective element comprising a varistor $D_{31}$ having a protective voltage of less than a breakdown voltage of a transistor $Tr_{11}$ serving as the series regulator B is inserted between the shield and ground. Therefore, breakdown of the transistor $Tr_{11}$ caused by an overvoltage can be prevented. In an arrangement of FIG. 4, the diode in FIG. 1 is reverse-biased. When an output from the pulse transformer $T_2$ is not enabled, the transistor $Tr_{11}$ is cut off, thus preventing application of an overvoltage in the collector-emitter path of the transistor $Tr_{11}$.

A resistor $R_{14}$ having a resistance of 1 kΩ to 1 MΩ is inserted between the series regulator B and the grid 6 or the shield, and a proper resistance is selected. Even if breakdown of the transistor $Tr_{11}$ occurs, a breakdown current can be reduced to a predetermined value or less, thereby preventing damage to the transistor $Tr_{11}$. A similar breakdown preventing effect can be obtained when a resistor of 1 kΩ to 1 MΩ is inserted between the series regulator B and ground.

The series regulator B is forward-biased (i.e., in an ON direction) when a feedback output is not applied, and has a high impedance and can be stably operated upon application of the feedback output from the insulating means A.

When an output appears on the secondary side of the pulse transformer $T_2$, the transistor $Tr_{11}$ receives a base current through a resistor $R_{11}$ and is turned on. Therefore, the instantaneous breakdown of the transistor $Tr_{11}$ upon application of a high voltage can be prevented.

Another arrangement without an insulating means A by employing positive charging according to another embodiment will be described with reference to FIGS. 5 and 6.

FIG. 5 shows an arrangement employing positive charging. In this case, the insulating means B can be omitted. An output from an error amplifier 4 can be directly applied to the base of a transistor $Tr_{11}$.

Figure 6A:
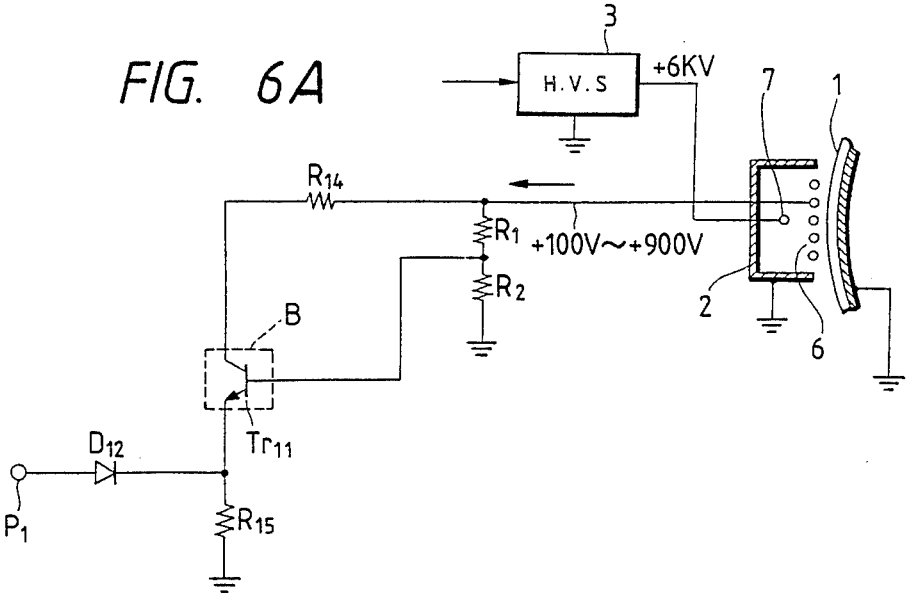
FIG. 6A is a schematic circuit diagram showing an arrangement without an error amplifier from the arrangement of FIG. 5.
Figure 6B:
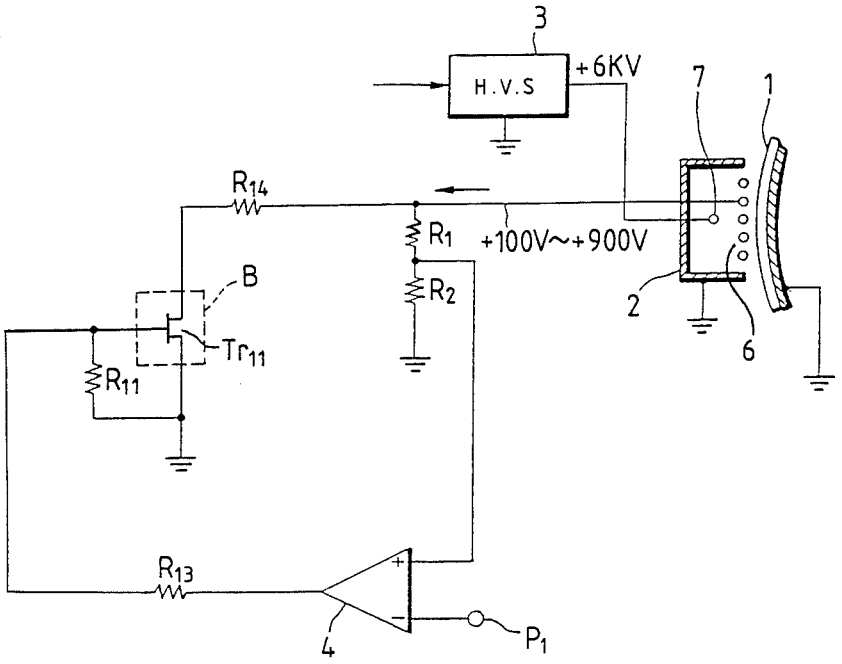
FIG. 6B is a schematic circuit diagram showing an arrangement using a field effect transistor.

FIG. 6A shows an arrangement employing positive charging, and an insulating means and an error amplifier 4 are not arranged therein. A reference voltage is directly applied to the emitter of a transistor $Tr_{11}$. A diode $D_{12}$ compensates for a shift caused by a base-emitter voltage of the transistor $Tr_{11}$. In this embodiment, the npn transistor is used as the transistor $Tr_{11}$, but, as shown in FIG. 6B, may be replaced with an FET (Field Effect Transistor). In this case, the gate of the FET is controlled in accordance with an output from the error amplifier 4.

The effects of the embodiments of the present invention will be compared with those of the conventional arrangement from the above description.

In the conventional arrangement, a power of 1.62 W is consumed by only the bleeder resistors $R_1$ and $R_2$. If efficiency of the converter transformer $T_1$ is given to be 70% to obtain a 1.8-W output with a slight margin, an input power of 2.6 W is required. However, according to the embodiments of the present invention, the series regulator B comprising the transistor $Tr_{11}$ or an FET is inserted in a route along which the current flows from the charge wire 7 to the grid 6 in principle. Therefore, the power consumption is zero.

The power consumption of the transistor $Tr_{11}$ is negligibly small, e.g., 20 mW at 100 V, and 27 mW at 900 V.

As is apparent from the above description, power efficiency of the embodiments of the present invention can be greatly improved.

In addition, a variable range of the bias voltage can be increased.

By eliminating the converter transformer $T_1$, a compact, low-noise apparatus which prevents an increase in temperature can be obtained to reduce cost and improve reliability.

Figure 7:
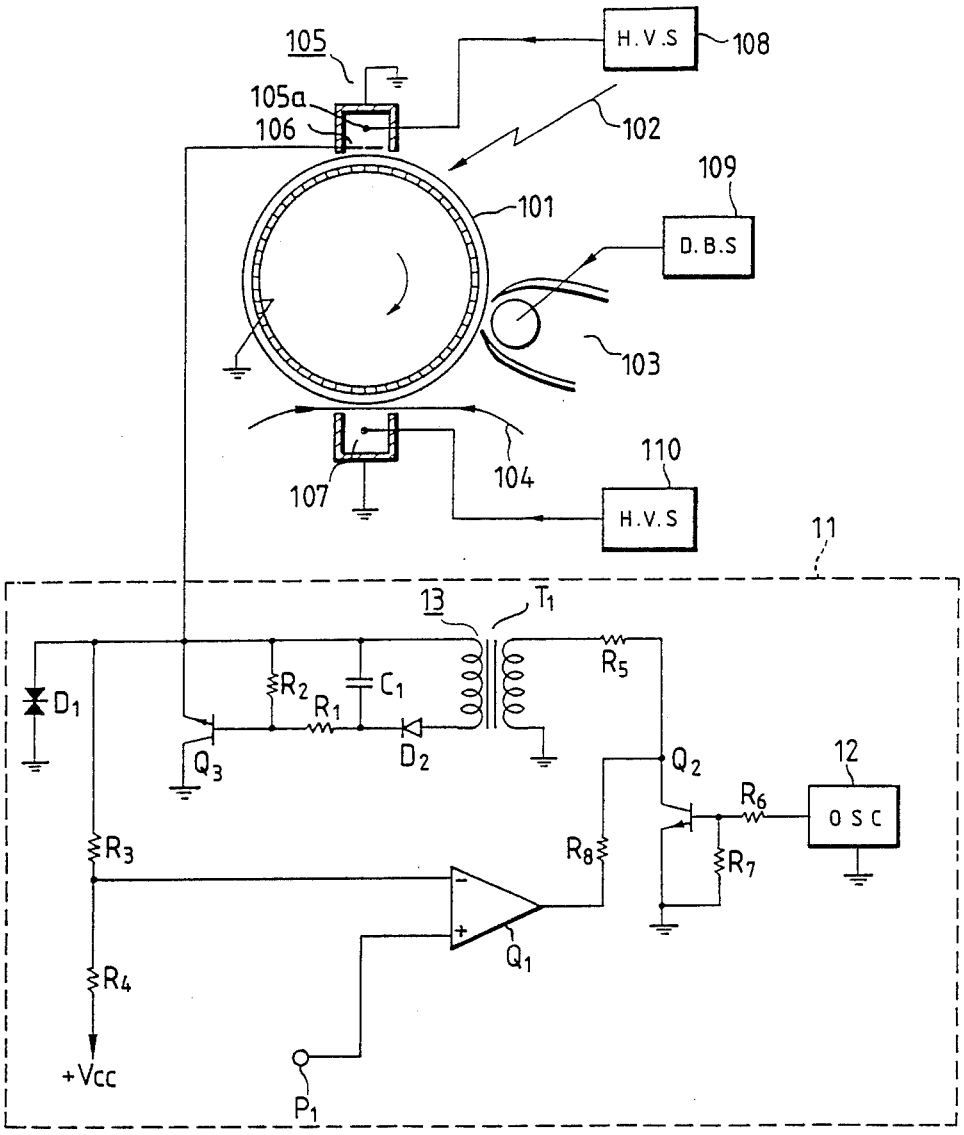
FIG. 7 is a view showing an image forming apparatus employing a power source apparatus according to the present invention.

FIG. 7 shows an embodiment in which the present invention is applied to an image forming apparatus employing an electrophotographic process.

Referring to FIG. 7, the image forming apparatus includes a photosensitive drum 101 serving as a photosensitive body, and an exposure light source 102 for exposing an image of an original or the like on the photosensitive drum 101 through an optical system (not shown) after the photosensitive drum 101 is cleaned and is charged by a primary charger 105 serving as a charging means (to be described later). A latent image is formed on the photosensitive drum 101 upon exposure with the exposure light source 102. The image forming apparatus also includes a developing unit 103. The latent image on the photosensitive drum 101 is developed by the developing unit 103, and the developed image is transferred to a transfer sheet 104. The image on the sheet 104 is processed by fixing and the like.

The primary charger 105 includes a charge wire 105*a*. A grid wire 106 is arranged between the charge wore 105*a* and the photosensitive drum 101. The surface of the photosensitive drum 101 travels along the primary charger 105 comprising the grid wire 106 and the charge wire 105*a* and is changed by the primary charger 105.

The image forming apparatus also includes a transfer charger 107, a high-voltage power source 110 for the transfer charger 107, a developing bias power source 109 for the developing unit 3, and a grid power source 111 for the grid wire 106 in the primary charger 105.

A high-voltage power source 108 supplies a high negative voltage of about −6 kV to the charge wire 105*a* of the primary charger 105 serving as the charging means. The grid wire 106 is arranged between the charge wire 105*a* and the photosensitive drum 101 as a drum in the image forming apparatus to stabilize charging. The grid wire 106 is connected to the grid power source 111, as described above.

In this embodiment, the grid power source is constituted by a series regulator using a transistor $Q_3$ having a high withstand voltage in the same manner as in FIG. 3. Since a load current itself is very small, the series regulator is inserted in the route of the load current flowing from ground to a high-voltage side, and an output from the series regulator is connected to the grid wire 106.

The operation of the arrangement shown in FIG. 7 is the same as that in FIG. 3, and a detailed description thereof will be omitted.

Figure 8:
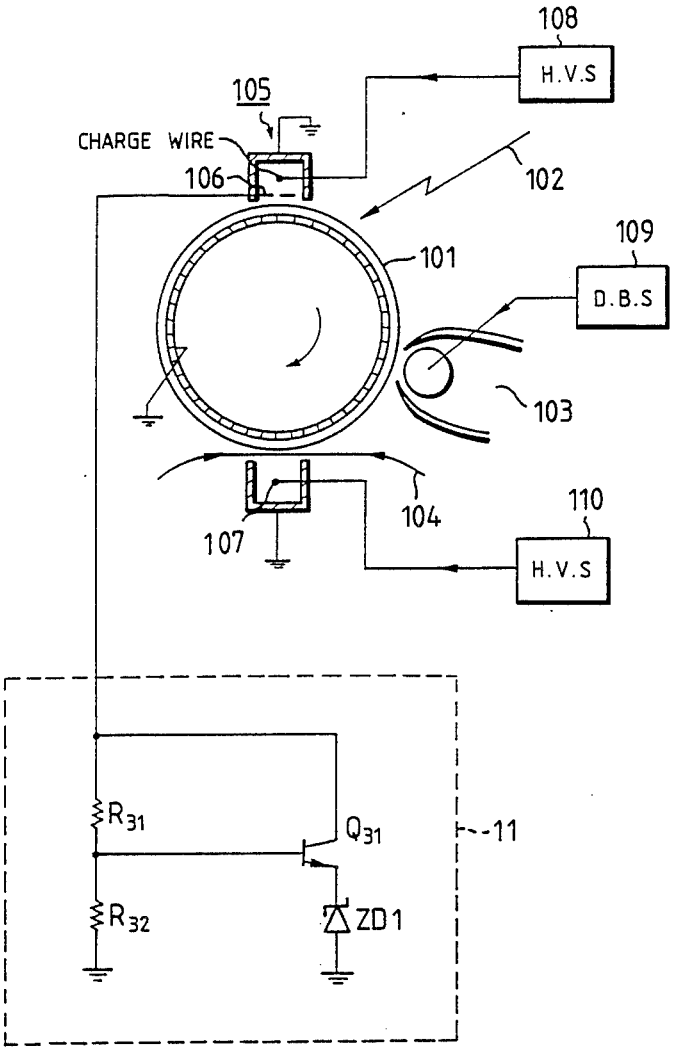
FIG. 8 is a view showing an arrangement using positive charging as a modification of FIG. 7.
Figure 10:
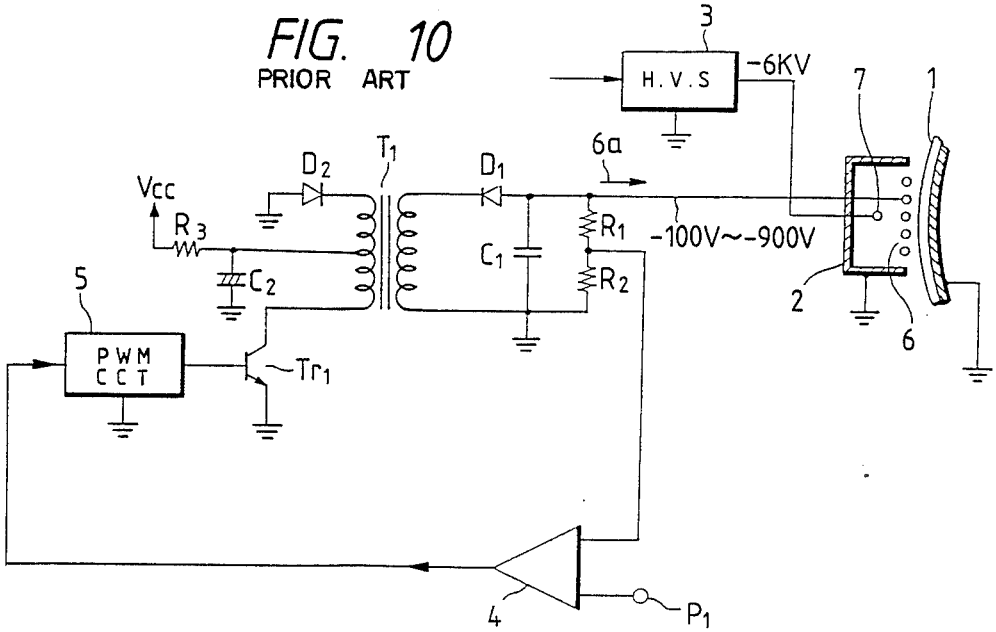
FIG. 10 PRIOR ART
FIG. 10 is a circuit diagram showing a conventional grid power source.

Still another embodiment will be described with reference to FIGS. 8 and 10. This is arrangement includes terminals $P_{41}$ and $P_{51}$, operational amplifiers $Q_{31}$, $Q_{41}$, and $Q_{51}$, a pnp transistor $Q_{42}$, a transistor $Q_{52}$ having a high withstand voltage, a photocoupler $Q_{53}$, resistors $R_{31}$, $R_{32}$, $R_{41}$ to $R_{44}$, and $R_{51}$ to $R_{56}$, and a Zener diode ZD1.

In the power source apparatuses of the previous embodiments, the charging voltage is the negative voltage. However, even if the charging voltage may be a positive voltage, as shown in FIG. 8, and especially the grid voltage is fixed, the same effect as described above can be obtained.

Figure 9:
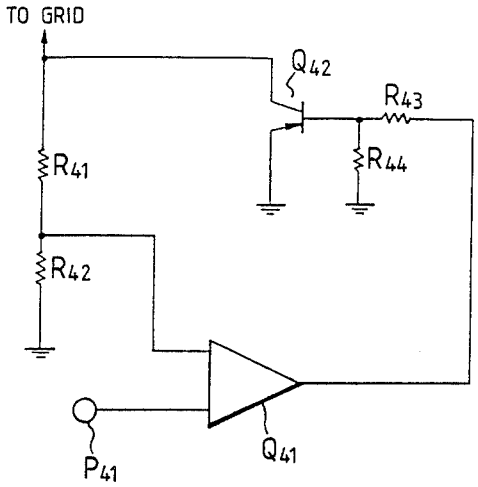
FIG. 9 is a view for explaining a pnp transistor in the modification of FIG. 8.

In the power source apparatuses of the previous embodiments, the charging means employs negative charging and the npn transistor having a high withstand voltage is used. However, as shown in FIG. 9, if a pnp transistor $Q_{42}$ is used as a series regulator, isolation is eliminated, i.e., the pulse transformer can be eliminated, thereby further simplifying the circuit arrangement.

In the above embodiment, the grid voltage is controlled, but the shield voltage may be controlled instead.

I claim:

1. A power source apparatus comprising:

high-voltage applying means for applying a high voltage to a charger;

detecting means for detecting a voltage of a grid of said charger; and regulator means, inserted between ground and said grid, for controlling the voltage of said grid to be constant in accordance with an output from said detecting means.

2. An apparatus according to claim 1, wherein said regulator means comprises a transistor, an emitter of which is connected to said grid, and a collector of which is grounded, a base current of said transistor being controlled in accordance with the output from said detecting means.

3. An apparatus according to claim 2, wherein said transistor comprises an npn transistor having a high withstand voltage.

4. An apparatus according to claim 1, further comprising an isolation circuit for outputting a control signal to said regulator means in accordance with the output from said detecting means.

5. An apparatus according to claim 4, wherein said isolation circuit comprises a DC-DC converter, a primary-side DC voltage of which is controlled in accordance with the output from said detecting means.

6. An apparatus according to claim 4, wherein said isolation circuit comprises a photocoupler.

7. An apparatus according to claim 2, wherein said transistor comprises a pnp transistor.

8. An apparatus according to claim 1, wherein said regulator means comprises a field effect transistor, a gate of which is controlled in accordance with the output from said detecting means.

9. A power source apparatus comprising:

high-voltage applying means for applying a high voltage to a charger;

detecting means for detecting a voltage of a shield of said charger; and regulator means, inserted between ground and said shield, for controlling the voltage of said shield to be constant in accordance with an output from said detecting means.

10. An apparatus according to claim 9, wherein said regulator means comprises a transistor, an emitter of which is connected to said shield, and a collector of which is grounded, a base current of said transistor being controlled in accordance with the output from said detecting means.

11. An apparatus according to claim 10, wherein said transistor comprises an npn transistor having a high withstand voltage.

12. An apparatus according to claim 9, further comprising an isolation circuit for outputting a control signal to said regulator means in accordance with the output from said detecting means.

13. An apparatus according to claim 12, wherein said isolation circuit comprises a DC-DC converter, a primary-side DC voltage of which is controlled in accordance with the output from said detecting means.

14. An apparatus according to claim 12, wherein said isolation circuit comprises a photocoupler.

15. An apparatus according to claim 10, wherein said transistor comprises a pnp transistor.

16. An apparatus according to claim 9, wherein said regulator means comprises a field effect transistor, a gate of which is controlled in accordance with the output from said detecting means.

* * * * *